US009630697B2

(12) United States Patent
Yamada et al.

(10) Patent No.: US 9,630,697 B2
(45) Date of Patent: Apr. 25, 2017

(54) OUTBOARD MOTOR

(71) Applicant: SUZUKI MOTOR CORPORATION, Hamamatsu, Shizuoka (JP)

(72) Inventors: Kenta Yamada, Hamamatsu (JP); Yasushi Miyashita, Hamamatsu (JP); Akinori Yamazaki, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/890,062

(22) PCT Filed: Apr. 9, 2015

(86) PCT No.: PCT/JP2015/061074

§ 371 (c)(1),
(2) Date: Nov. 9, 2015

(87) PCT Pub. No.: WO2015/163154

PCT Pub. Date: Oct. 29, 2015

(65) Prior Publication Data

US 2016/0107738 A1 Apr. 21, 2016

(30) Foreign Application Priority Data

Apr. 24, 2014 (JP) ..... 2014-089919
Jun. 3, 2014 (JP) ..... 2014-114951

(51) Int. Cl.
*F02B 61/04* (2006.01)
*B63H 20/32* (2006.01)
(Continued)

(52) U.S. Cl.
CPC ..... *B63H 20/32* (2013.01); *B63H 20/245* (2013.01); *F02B 61/045* (2013.01); *F02M 35/167* (2013.01)

(58) Field of Classification Search
CPC ..... B63H 20/32; B63H 20/245; F02B 61/045; F02B 61/04; F02B 67/00; F02M 35/167
See application file for complete search history.

(56) References Cited

U.S. PATENT DOCUMENTS 5,445,547 A * 8/1995 Furukawa ..... F02B 61/045 440/77
7,425,163 B2 9/2008 Murai et al. ..... 440/77
(Continued)

FOREIGN PATENT DOCUMENTS

JP 2007-69823 A 3/2007
JP 2013-96342 A 5/2013

*Primary Examiner* — Anthony Wiest
(74) *Attorney, Agent, or Firm* — Stein IP, LLC

(57) ABSTRACT

[Problem] To perform an assembling operation easily while attaining improvement in engine efficiency.

[Solution] An outboard motor 10 according to the invention includes an upstream side duct 42 which is fixed to an engine upper cover 27, and a downstream side duct 43 which is fixed to an engine 14 side. The upstream side duct 42 includes an exhaust port 52 which is opened at its side face. The downstream side duct 43 includes a downstream side lower duct 59 and a downstream side upper duct 60. In the downstream side lower duct 59, a suction port 61 is provided at a position opposed to the exhaust port 52 and separately at a predetermined distance from the exhaust port 52. In the downstream side upper duct 60, an exhaust port formed toward a throttle body 36 of the engine 14 is provided above the downstream side lower duct 59. The upstream side duct 42 and the downstream side duct 43 are formed so as not to interfere with each other when the engine upper cover 27 is moved vertically.

7 Claims, 6 Drawing Sheets

(51) Int. Cl.
*B63H 20/24* (2006.01)
*F02M 35/16* (2006.01)

(56) References Cited

U.S. PATENT DOCUMENTS

| | | | | |
|---|---|---|---|---|
| 2002/0025739 | A1* | 2/2002 | Nemoto | F02B 61/045 440/77 |
| 2007/0054569 | A1 | 3/2007 | Murai et al. | 440/77 |

* cited by examiner

OUTBOARD MOTOR

CROSS-REFERENCE TO RELATED APPLICATIONS

This application is a national stage of International Application No. PCT/JP2015/061074, filed Apr. 9, 2015, which claims the benefit of priority to Japanese Application No. 2014-089919, filed Apr. 24, 2014, and Japanese Application No. 2014-114951, filed Jun. 3, 2014, in the Japanese Patent Office, the disclosures of which are incorporated herein by reference.

TECHNICAL FIELD

The present invention relates to an outboard motor including an intake pathway by which air sucked from the outside is guided to a throttle body inside an engine cover.

BACKGROUND ART

Generally, an engine has such a characteristic that the output of the engine increases as the intake temperature of the engine decreases. Therefore, an opening portion for introducing outside air is provided in an engine cover in the case of an outboard motor in which the engine is covered with the engine cover.

However, when such an opening portion is simply provided at the engine cover, there is a fear that air sucked inside the engine cover through the opening portion may become high in temperature due to heat generated by the engine to thereby increase the intake temperature of the engine.

Therefore, in the background art, there is proposed an outboard motor provided with an intake device. The intake device is provided with left and right intake passages by which air introduced into the inside of the outboard motor through the opening portion of the engine cover is guided to a throttle body, and left and right interference type silencers which are provided in the middle of the intake passages respectively (e.g. see Patent Literatures 1 and 2).

PRIOR ART DOCUMENTS

Patent Literature

Patent Literature 1: JP-A-2007-69823
Patent Literature 2: JP-A-2013-96342

SUMMARY OF INVENTION

Problems to be Solved by the Invention

However, in the aforementioned outboard motor described in any of Patent Literatures 1 and 2, the intake device has a complicated structure. For this reason, there is a problem that it may take time and labor to perform an outboard motor assembling operation and it may be difficult to miniaturize the outboard motor.

In addition, in the case where water spray, rainwater, etc. during sailing using the outboard motor enters the intake device through the opening portion for introducing outside air, it is difficult to drain the water. Therefore, there is also a problem that corrosion may occur easily inside the engine.

The invention has been accomplished in order to solve the aforementioned problems. An object of the invention is to provide an outboard motor for which an outboard motor assembling operation can be performed easily while efficiency of an engine is improved, and which can be miniaturized and suppress corrosion inside the engine.

Means for Solving the Problems

In order to achieve the aforementioned object, the invention provides an outboard motor including: an intake pathway by which air sucked from the outside into an intake space inside an engine cover through an outside air intake port provided at the engine cover covering an engine is guided to a throttle body of the engine, wherein: the engine cover is formed to be able to be split into an engine lower cover and an engine upper cover in an up/down direction; the intake pathway includes an upstream side duct and a downstream side duct, the upstream side duct being fixed to the engine upper cover of the engine cover so that air can circulate downward in the upstream side duct, the downstream side duct being fixed to the engine side in parallel with the upstream side duct so that air can circulate upward in the downstream side duct; the upstream side duct includes an exhaust port which is opened at its side face; the downstream side duct includes a downstream side lower duct and a downstream side upper duct, the downstream side lower duct extending upward so as to form an air ascending flow, the downstream side lower duct including a suction port provided at a position opposed to the exhaust port and separately at a predetermined distance from the exhaust port, the downstream side upper duct being formed toward the throttle body of the engine above the downstream side lower duct, the downward side upper duct including an exhaust port communicating with the throttle body; and the upstream side duct and the downstream side duct are formed so as not to interfere with each other when the engine upper cover of the engine cover is moved vertically.

In addition, in the outboard motor according to the invention, the upstream side duct is formed by: an upstream side upper duct which is fixed to an upper portion of the engine upper cover to thereby form an upper space; and an upstream side lower duct which is fixed to a lower face of the upstream side upper duct to thereby form an air descending flow space between the upstream side lower duct and the engine upper cover, and which includes the exhaust port opened at its side face.

In addition, in the outboard motor according to the invention, the upstream side duct includes: an upstream side upper duct which is fixed to an upper portion of the engine upper cover to form an upper space; and an upstream side lower duct which is formed below the upstream side upper duct to extend downward to a rear lower portion of the engine; an upper suction port which communicates with the outside air intake port through the intake space is formed at the upstream side upper duct; and the exhaust port is provided at the side face of the upstream side lower duct.

By use of such a configuration, the upstream side duct and the downstream side duct can be prevented from making contact with each other when the engine upper cover of the engine cover is attached or detached. Accordingly, an outboard motor assembling operation can be simplified and the intake pathway can be formed easily inside the engine cover. In addition, outside air can be guided directly to the throttle body of the engine through the intake pathway. Accordingly, the intake temperature of the engine can be reduced so that the output of the engine can be increased.

In addition, in the outboard motor according to the invention, preferably, a lower end of the upstream side duct is opened downward.

By use of such a configuration, even when, for example, water drops of water spray, rainwater, etc. during Sailing directly enter the intake pathway or air including water enters the intake pathway from the outside, the water separated from the air or the water drops can be surely discharged to the outside from the lower end of the upstream side duct. Accordingly, water drops or water can be prevented from entering the engine and occurrence of corrosion inside the engine can be suppressed.

In addition, in the outboard motor according to the invention, it is preferable that the upper suction port is opened upward, a rising portion is formed to surround the upper suction port, and the upstream side upper duct is formed to be slanted downward to the outside air intake port.

By use of such a configuration, water can be separated from outside air either before the air is introduced into the intake pathway or in the intake pathway so that the water can be drained to the outside. Therefore, the water can be prevented from entering the engine. Accordingly, occurrence of corrosion inside the engine can be suppressed.

Advantageous Effects of Invention

According to the invention, it is possible to obtain various excellent effects that an outboard motor assembling operation can be performed easily while improvement in efficiency of the engine is attained, miniaturization can be achieved, an effect that corrosion inside the engine can be suppressed, etc.

EMBODIMENTS FOR CARRYING OUT THE INVENTION

An outboard motor according to an embodiment of the invention will be described below with reference to the drawings. Incidentally, in the following description, directions toward the front, the rear, the left and the right will be indicated based on moving directions of a hull.

First, an overall configuration of an outboard motor 10 according to the embodiment of the invention will be described with reference to FIG. 1. Here, FIG. 1 is a side view showing the outboard motor 10 according to the embodiment of the invention.

Figure 1:
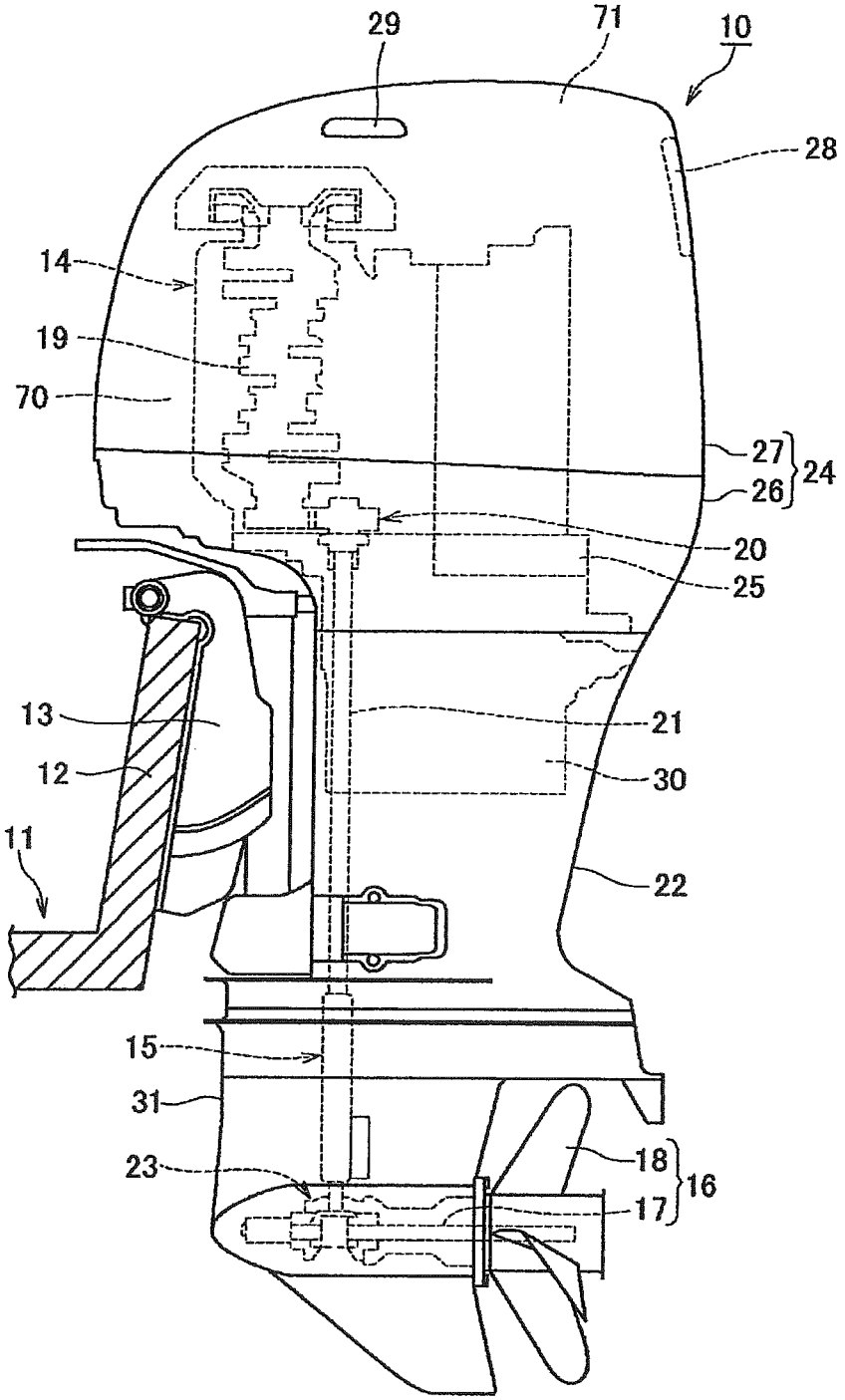
FIG. 1 A side view showing an outboard motor according to an embodiment of the invention.

As shown in FIG. 1, the outboard motor 10 is attached to a transom 12 of a hull 11 through an attachment bracket 13 so as to be rotatable in an up/down direction. The outboard motor 10 is provided with an engine 14. The output from the engine 14 is transmitted to a propulsion machine 16 through a power transmission device 15. The propulsion machine 16 is provided with a propeller shaft 17 and a propeller 18. The engine output is transmitted to the propeller shaft 17. The propeller 18 is fixed to the propeller shaft 17.

The engine 14 is a vertical type four-cylinder engine inside which a crankshaft 19 is disposed substantially vertically. The engine output is extracted from a lower end of the crankshaft 19. The lower end portion of the crankshaft 19 is connected to an upper end portion of a driveshaft 21 through a primary gear device 20. The driveshaft 21 extends substantially vertically downward inside a main body housing 22. A lower end portion of the driveshaft 21 is connected to the propeller shaft 17 through a bevel gear device 23. The power transmission device 15 is constituted by the primary gear device 20, the driveshaft 21 and the bevel gear device 23.

An engine cover 24 is provided in an upper portion of the main body housing 22 liquid-tightly. The inside of the engine cover 24 is roughly divided into an engine room 70 and an intake space 71. The intake space 71 is formed to extend over the rear of the engine room 70 from an upper side of the engine room 70. The engine 14 and an engine holder 25 are received in the engine room 70. The engine 14 is attached to an upper portion of the engine holder 25.

An engine lower cover 26 and an engine upper cover 27 are assembled into the engine cover 24 liquid-tightly so that the engine cover 24 can be split into two in an up/down direction. The engine holder 25 is received inside the engine lower cover 26. The attachment bracket 13 is mounted on the engine holder 25. An outside air intake port 28 is opened at a rear-side upper portion of the engine upper cover 27. An exhaust port 29 is opened at a left-side upper portion of the engine upper cover 27.

An oil pan 30 is provided below the engine holder 25. The oil pan 30 is received inside the main body housing 22. The driveshaft 21 of the power transmission device 15 is received in the main body housing 22 to be insertable in a longitudinal direction. A gear casing 31 is provided in a lower portion of the main body housing 22 liquid-tightly. The bevel gear device 23 is stored inside the gear casing 31.

Figure 2:
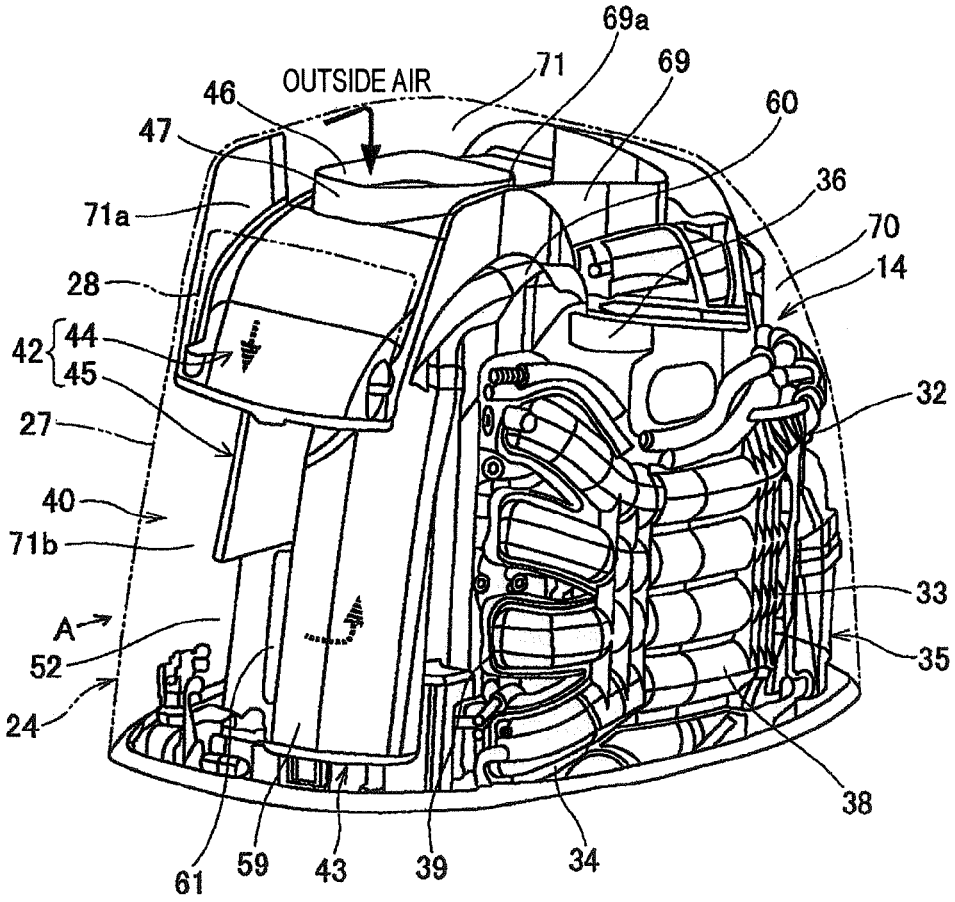
FIG. 2 A perspective view showing the outboard motor according to a first embodiment of the invention.
Figure 3:
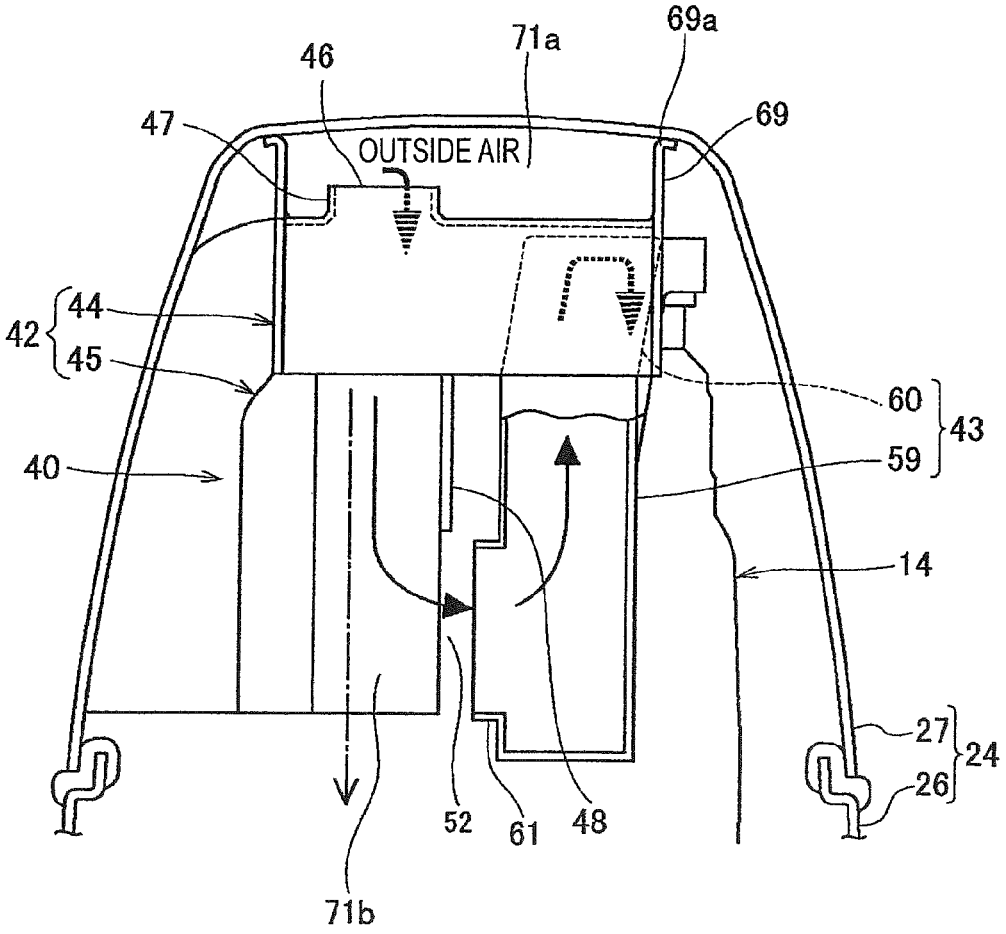
FIG. 3 A view taken along an arrow A of FIG. 2.
Figure 4:
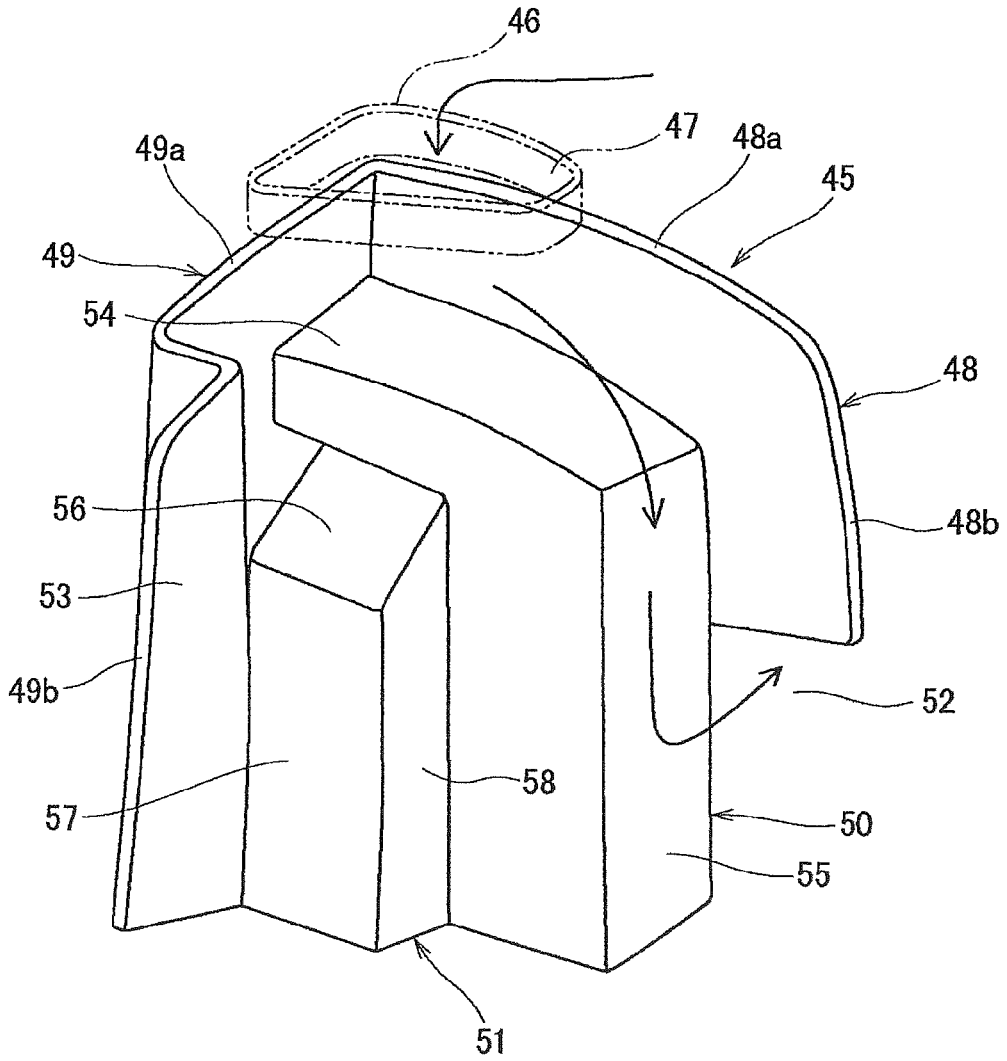
FIG. 4 A perspective view showing an upstream side lower duct of the outboard motor according to the first embodiment of the invention.

Next, the configuration of the outboard motor 10 inside the engine cover 24 according to a first embodiment of the invention will be described with reference to FIGS. 2 to 4. Here, FIG. 2 is a perspective view showing the outboard motor according to the first embodiment of the invention. FIG. 3 is a view taken along an arrow A of FIG. 2. FIG. 4 is a perspective view showing an upstream side lower duct of the outboard motor according to the first embodiment of the invention.

As shown in FIG. 2, the engine 14 is provided with an engine block 35 including a crankcase 32, a cylinder block 33 and a cylinder head 34. The crankcase 32 is disposed in a front portion of the engine 14. The cylinder block 33 is provided integrally with the rear of the crankcase 32. The cylinder head 34 is provided integrally with the rear of the cylinder block 33. A throttle body 36 for supplying a fuel-air mixture to respective cylinders of the cylinder block 35 is provided in the engine 14. Intake manifolds 38 are connected from the throttle body 36 to air intake ports 39. The air intake ports 39 extend in accordance with the respective cylinders and are formed in the cylinder head 34.

As exactly shown in FIG. 3, an intake pathway 40 which is formed into a U-shape when viewed from the back is formed in the intake space 71 inside the engine cover 24. The intake pathway 40 is provided with the engine cover 24, an upstream side duct 42 and a downstream side duct 43. The upstream side duct 42 is fixed to the engine cover 24 so that air can circulate downward in the upstream side duct 42. The downstream side duct 43 is fixed to the engine 14 side in parallel with the upstream side duct 42 so that air can circulate upward in the downstream side duct 43. A lower end of the upstream side duct 42 is opened.

As shown in FIGS. 2 to 4, the upstream side duct 42 is provided with an upstream side upper duct 44 and an upstream side lower duct 45. The upstream side upper duct 44 is formed to cover a rear portion of the engine 14 from above, and to be slanted downward to the outside air intake port 28 so as to partition an upper space 71*a* of the intake space 71. The upstream side lower duct 45 is fixed to a lower face of the upstream side upper duct 44 so that an air descending flow space 71*b* can be formed between the engine cover 24 and the upstream side lower duct 45.

An upper suction port 46 is opened upward in the upstream side upper duct 44. A rising portion 47 is formed to surround the upper suction port 46. The upper suction port 46 and the outside air intake port 28 communicate with each other through the upper space 71*a* of the intake space 71. In addition, a partition plate 69 is provided erectly on a front edge portion and left and right edge portions of the upstream side upper duct 44. An upper end 69*a* of the partition plate 69 has a shape following an inner face of the engine upper cover 27 and is fixed to the inner face of the engine upper cover 27 through a seal.

As exactly shown in FIG. 4, a right side face 48 and a front face 49 are formed in the upstream side lower duct 45. The right side face 48 is formed to be opposed to the downstream side duct 43. The front face 49 is bent leftward from a front end portion of the right side face 48 substantially at right angles. In addition, a first bulge portion 50 and a second bulge portion 51 are formed stepwise in the upstream side lower duct 45 so as to avoid interference with the engine 14. The first bulge portion 50 is provided protrusively on a left side of the right side face 48. The second bulge portion 51 is provided on a further left side of the first bulge portion 50.

A lower portion of a rear end of the right side face 48 is opened to form an exhaust port 52. An upper end 48*a* of the right side face 48 has a shape following an inner face of the upstream side upper duct 44. In addition, the rear end 48*b* of the right side face 48 has a shape following an inner face of the edge upper cover 27 and is fixed to the inner face of the engine upper cover 27 through a seal.

A left end portion 53 of the front face 49 is formed into a crank shape to be bent rearward. An upper end 49*a* of the front face 49 has a shape following the inner face of the upstream side upper duct 44. In addition, a left end 49*b* of the front face 49 has a shape following the inner face of the engine upper cover 27 and is fixed to the inner face of the engine upper cover 27 through a seal.

The first bulge portion 50 is formed into a box shape which is flat in a left/right direction. An upper face 54 of the first bulge portion 50 extends along the right side face 48 in a front/rear direction, and is slanted slightly downward to the rear. A front portion of the upper face 54 is disposed below the upper suction port 46 of the upstream side upper duct 44. A rear face 55 of the first bulge portion 50 extends in an up/down direction and disposed in front of the exhaust port 52 of the right side face 48.

The second bulge portion 51 is formed into a vertically long box shape. An upper face 56 of the second bulge portion 51 is formed below the upper face 54 of the first bulge portion 50 and slanted downward to the left. A left side face 57 of the second bulge portion 51 is disposed on a right side of the left end 49*b* of the front face 49. A rear face 58 of the second bulge portion 51 is disposed in front of the rear face 55 of the first bulge portion 50.

Refer to FIGS. 2 and 3 again. The downstream side duct 43 has a flat shape extending from a rear lower right portion of the engine 14 to bend toward an upper right side of the engine 14. The downstream side duct 43 also functions as a silencer. The downstream side duct 43 is provided with a downstream side lower duct 59 and a downstream side upper duct 60. The downstream side lower duct 59 extends upward from the rear lower portion of the engine 14 so as to form an air ascending flow. The downstream side upper duct 60 is formed above the downstream side lower duct 59 and below the upstream side upper duct 44 to extend toward the throttle body 36 of the engine 14.

A suction port 61 formed into a vertically long shape is provided in a left side face of the downstream side lower duct 59 to protrude leftward in a position opposed to the exhaust port 52 of the upstream side duct 42. The suction port 61 is separated at a predetermined distance from the exhaust port 52. An exhaust port (not shown) is formed in the downstream side upper duct 60, and the exhaust port is connected to an intake port of the throttle body 36. When the upstream side duct 42 and the downstream side duct 43 are formed thus, the upstream side lower duct 45 and the downstream side lower duct 59 can be prevented from overlapping with each other in plan view.

Next, the flow of air in the outboard motor 10 having the aforementioned configuration inside the engine cover 14 during running will be described with reference to FIGS. 2 to 4.

When the engine 14 starts up, first, outside air flows into the inside of the engine cover 24 through the outside air intake port 28. The air passes through the upper space 71*a* of the intake space 71 and is then sucked into the descending flow space 71*b* through the upper suction port 46. On this occasion, water spray entering through the outside air intake port 28 or water contained in the air collides against the rising portion 47 of the upper suction port 46 so as to be separated from the air. Thus, the water can be prevented from flowing into the descending flow space 71*b*. In addition, the water separated by the rising portion 47 of the upper suction port 46 can be not only prevented by the partition plate 69 from falling down from the upper space 71*a* into the descending flow space 71*b* but also discharged to the outside from the outside air intake port 28 in accordance with the slope of the upstream side upper duct 44.

Then, the air sucked into the descending flow space 71*b* of the upstream side duct 42 descends mainly along the upper face 54 and the rear face 55 of the first bulge portion 50. At a lower end of the first bulge portion 50, the air changes the direction of its flow to a direction toward the exhaust port 52 side so that the air can be emitted from the exhaust port 52 toward the suction port 61 of the downstream side duct 43. On this occasion, water in the air is separated by collusion against the first bulge portion 50 or by a centrifugal force when the air changes the direction of its flow. The separated water is surely discharged outside the upstream side duct 42 from the opening at the lower end of the upstream side duct 42, as designated by a one-dot chain line in FIG. 3.

The air from which the water has been separated thus is emitted from the exhaust port 52 and flows into the downstream side duct 43 through the suction port 61. Then, the air ascends inside the first duct 59 of the downstream side duct 43, passes through the fourth duct 60, and is sucked into the intake port of the throttle body 36. Then, the air is supplied to the respective cylinders of the engine 14 through the intake manifolds 38 respectively.

According to the outboard motor 10 according to the aforementioned embodiment of the invention, the upstream side lower duct 45 fixed to the engine cover 24 and the downstream side lower duct 59 fixed to the engine 14 side are formed in parallel with each other and the downstream side upper duct 60 is formed below the upstream side upper duct 44. Further, the exhaust port 52 and the suction port 61 are provided separately from each other so that the upstream side lower duct 45 and the downstream side lower duct 59 can be prevented from overlapping with each other in plan view. With these configurations, the upstream side duct 42 and the downstream side duct 43 can be prevented from interfering with each other when the engine upper cover 27 of the engine cover 24 is attached or detached. Accordingly, an operation of assembling the outboard motor 10 can be simplified. The intake pathway 40 can be formed easily inside the engine cover 24.

Before outside air is introduced into the throttle body 36 of the engine 14 or the engine room 70, air-water separation is performed in the rising portion 47 of the upper suction port 46. Accordingly, entry of water into the throttle body 36 of the engine 14 or the engine room 70 can be suppressed.

Further, for example, even when water drops of water spray, rainwater, etc. during sailing directly enters the intake pathway 40 or air containing water enters the intake pathway 40 through the outside air intake port 28, the water drops or the water can be drained easily from an opening at the lower end of the upstream side duct 42. Accordingly, the water drops or the water can be prevented from entering the engine 14 so that occurrence of corrosion inside the engine 14 can be suppressed.

Further, outside air can be introduced directly into the throttle body 36 of the engine 14 through the intake pathway 40. Accordingly, the intake temperature of the engine 14 can be reduced so that the output of the engine 14 can be increased.

Further, the intake pathway 40 is formed in the intake space 71 which is formed to extend over the rear of the engine room 70 from the upper side of the engine room 70. Accordingly, the dimensions of the engine cover 24 can be suppressed to the minimum so that the increase of the size of the outboard motor can be prevented.

Incidentally, in the aforementioned embodiment of the invention, the upstream side lower duct 45 and the downstream side lower duct 59 are formed so as not to overlap with each other in plan view. However, there is no intension to limit the invention to the embodiment. That is, various modifications can be made as long as the upstream side duct 42 and the downstream side duct 43 can be formed so as not to interfere with each other when the engine cover 24 is moved vertically to be attached/detached. For example, the lower end of the right side face 48 may be disposed above the suction port 61 of the downstream side duct 43 and the right side face 48 of the upstream side lower duct 45 may be formed so as to overlap with the suction port 61 in plan view.

Figure 5:
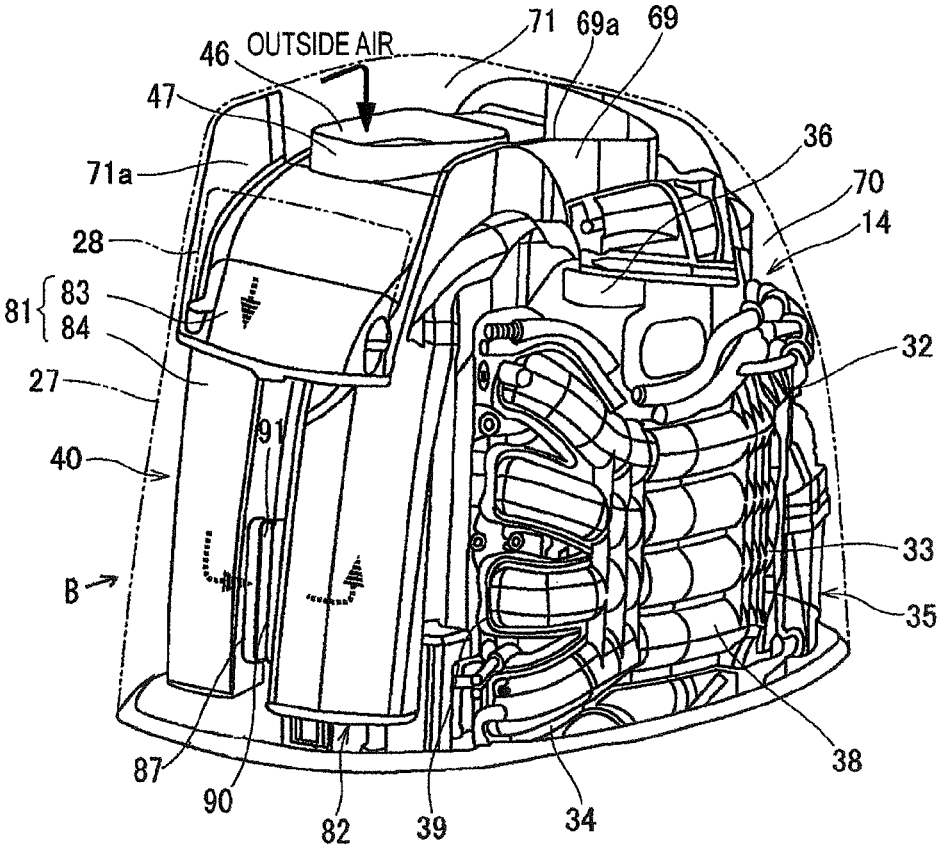
FIG. 5 A perspective view showing an outboard motor according to a second embodiment of the invention.
Figure 6:
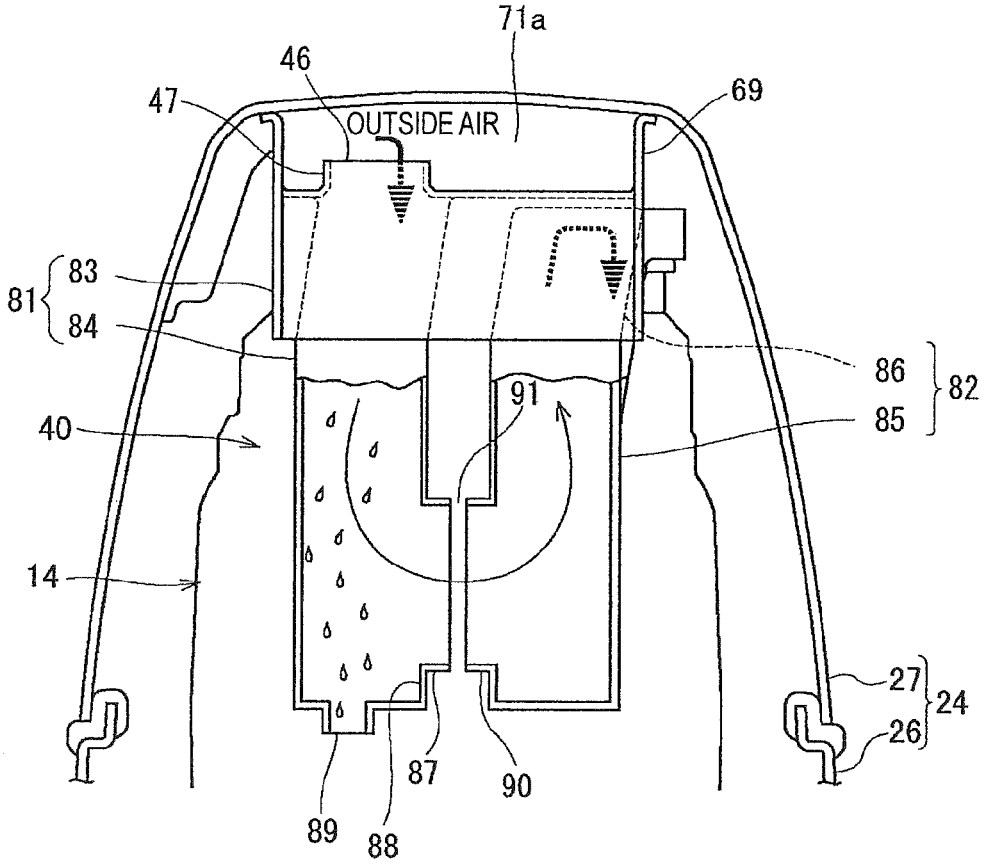
FIG. 6 A view taken along an arrow B of FIG. 5.

Next, a configuration of an outboard motor 10 inside an engine cover 24 according to a second embodiment of the invention will be described with reference to FIGS. 5 and 6. Here, FIG. 5 is a perspective view showing the outboard motor according to the second embodiment of the invention. FIG. 6 is a view taken along an arrow B of FIG. 5. Incidentally, in the following description, equivalent constituents in FIGS. 5 and 6 to those in the aforementioned first embodiment will be referred to by the same numerals or signs as those in FIGS. 2 to 4 respectively in order to simplify explanation, and detailed description of those constituents will be omitted.

As exactly shown in FIG. 6, an intake pathway 40 which is formed into a U-shape when viewed from the back is formed in an intake space 71 inside the engine cover 24. The intake pathway 40 is provided with an upstream side duct 81 and a downstream side duct 82. The upstream side duct 81 is fixed to the engine cover 24 and formed to extend downward so that cir can circulate downward in the upstream side duct 81. The downstream side duct 82 is fixed to an engine 14 and formed to extend upward and in parallel with the upstream side duct 81 so that air can circulate upward in the downstream side duct 82.

The upstream side duct 81 is provided with an upstream side upper duct 83 and an upstream side lower duct 84. The upstream side upper duct 83 is formed to cover a rear portion of the engine 14 from above and provided to be slanted downward to an outside air intake port 28. The upstream side lower duct 84 is connected to a lower side of the upstream side upper duct 83, and formed into a flat shape to extend from an upper left side of the engine 14 and bend toward a rear lower left portion of the engine 14.

An upper suction port 46 is opened upward in an upper portion of the upstream side upper duct 83. A rising portion 47 is formed to surround the upper suction port 46. The upper suction port 46 and the outside air intake port 28 communicate with each other through an upper space 71*a* of the intake space 71. In addition, a partition plate 69 is provide erectly on a front edge portion and left and right edge portions of the upstream side upper duct 83. An upper end of the partition plate 69 has a shape following an inner face of an engine upper cover 27.

An exhaust port 87 formed into a vertically long shape is provided to protrude rightward in a right side face of a lower portion of the upstream side lower duct 84. A step portion 88 is formed under the exhaust port 87. A water drainage hole 89 is opened at the bottom of a lower end of the upstream side lower duct 84.

The downstream side duct 82 has a flat shape extending from a rear lower right portion of the engine 14 and bending toward an upper right side of the engine 14. The downstream side duct 82 also functions as a silencer. The downstream side duct 82 is provided with a downstream side lower duct 85 and a downstream side upper duct 86. The downstream side lower duct 85 is formed in parallel with the upstream side lower duct 84 and extends upward from the rear lower portion of the engine 14. The downstream side upper duct 86 is formed above the downstream side lower duct 85 and below the upstream side upper duct 83 to extend toward a throttle body 36 of the engine 14.

A suction port 90 which is formed into a vertically long shape is provided in a left side face of the downstream side lower duct 85 to protrude leftward in a position opposed to the exhaust port 87 of the upstream side duct 81. The suction port 90 is separated at a predetermined distance from the exhaust port 87. An open portion 91 is formed to be vertically long between the exhaust port 87 and the suction port 90. In addition, an exhaust port (not shown) is formed in the downstream side upper duct 86, and the exhaust port is connected to an intake port of the throttle body 36. When the upstream side duct 81 and the downstream side duct 82 are formed thus, the upstream side lower duct 84 and the downstream side lower duct 85 can be prevented from overlapping with each other in plan view.

Next, the flow of air in the outboard motor 10 having the aforementioned configuration inside the engine cover 14 during running will be described with reference to FIGS. 5 and 6.

When the engine 14 starts up, first, outside air flows into the inside of the engine cover 24 through the outside air intake port 28. The air passes through the upper space 71*a* of the intake space 71 and is then sucked into the upstream side lower duct 84 through the upper suction port 46. On this occasion, water spray entering through the outside air intake port 28 or water contained in the air collides against a rising portion 47 of the upper suction port 46 so as to be separated from the air. Thus, the water can be prevented from flowing into the upstream side lower duct 84. In addition, the water separated by the rising portion 47 of the upper suction port 46 can be not only prevented by the partition plate 69 from falling down from the upstream side upper duct 83 into the engine room 70 below the partition plate 69 but also discharged to the outside from the outside air intake port 28 in accordance with the slope of the upstream side upper duct 83.

Then, the air sucked into the upstream side lower duct 84 descends inside the upstream side lower duct 84. At the lower end of the upstream side lower duct 84, the air changes the direction of its flow to a direction toward the exhaust port 87 side so that the air can be emitted from the exhaust port 87 toward the suction port 90 of the downstream side duct 82. On this occasion, water in the air is separated by a centrifugal force when the air changes the direction of its flow and by collusion against the step portion 87. The separated water is surely discharged outside the upstream side lower duct 84 from the water drainage hole 89.

The air from which the water has been separated thus is emitted from the exhaust port 87 and flows into the downstream side duct 82 through the suction port 90. Then, the air ascends inside the downstream side lower duct 85, passes through the downstream side upper duct 86, and is sucked into the intake port of the throttle body 36. Then, the air is supplied to the respective cylinders of the engine 14 through the intake manifolds 38 respectively.

According to the outboard motor 10 according to the aforementioned embodiment of the invention, the upstream side lower duct 84 fixed to the engine cover 24 and the downstream side lower duct 85 fixed to the engine 14 side are formed in parallel with each other, and the downstream side upper duct 86 is formed below the upstream side upper duct 83. Further, the exhaust port 87 and the suction port 90 are provided separately from each other so that the upstream side lower duct 84 and the downstream side lower duct 85 can be prevented from overlapping with each other in plan view. Thus, the upstream side duct 41 and the downstream side duct 42 can be prevented from making contact with each other when the engine upper cover 27 of the engine cover 24 is attached or detached. Accordingly, an operation of assembling the outboard motor 10 can be simplified. The intake pathway 40 can be formed easily inside the engine cover 24.

Before outside air is introduced into the throttle body 36 of the engine 14 or the engine room 70, air-water separation is performed in the rising portion 47 of the upper suction port 46. Accordingly, entry of water into the throttle body 36 of the engine 14 or the engine room 70 can be suppressed.

Further, for example, even when water drops of water spray, rainwater, etc. during sailing directly enter the intake pathway 40 or air containing water enters the intake pathway 40 through the outside air intake port 28, air and water can be separated from each other surely at the lower end of the upstream side lower duct 84 so that the water drops or the water generated thus can be drained easily from the water drainage hole 89. Accordingly, the water drops or the water can be prevented from entering the engine 14 so that occurrence of corrosion inside the engine 14 can be suppressed.

Further, outside air can be directly guided to the throttle body 36 of the engine 14 through the intake pathway 40. Accordingly, the intake temperature of the engine 14 can be reduced so that the output of the engine 14 can be increased.

Further, the intake pathway 40 is formed in the intake space 71 which is formed to extend over the rear of the engine room 70 from the upper side of the engine room 70. Accordingly, the dimensions of the engine cover 24 can be suppressed to the minimum so that the increase of the size of the outboard motor can be prevented.

Incidentally, the aforementioned embodiments of the invention have been described as preferred embodiments in the outboard motor according to the invention. Accordingly, various technically preferable limitations may be given but there is no intension to limit the technical scope of the invention to these forms as long as there is no particular description for limiting the invention. That is, constituent elements in the aforementioned embodiments of the invention can be replaced by existing constituent elements etc. suitably and various variations including other combinations with the existing constituent elements can be made. Description about the aforementioned embodiments of the invention does not limit the contents of the invention described in the scope of Claims.

REFERENCE SIGNS LIST

10 outboard motor
14 engine
24 engine cover
26 engine lower cover
27 engine upper cover
28 outside air intake port
36 throttle body
40 intake pathway
42 upstream side duct
43 downstream side duct
44 upstream side upper duct
45 upstream side lower duct
46 upper suction port
47 rising portion
52 exhaust port
59 downstream side lower duct
60 downstream side upper duct
61 suction port
71 intake space
71*a* upper space
71*b* descending flow space
81 upstream side duct
82 downstream side duct
83 upstream side upper duct
84 upstream side lower duct
85 downstream side lower duct
86 downstream side upper duct
87 exhaust port
89 water drainage hole
90 suction port

The invention claimed is:

1. An outboard motor comprising: an intake pathway by which air sucked from outside into an intake space inside an engine cover through an outside air intake port provided at the engine cover covering an engine is guided to a throttle body of the engine, wherein:

the engine cover is formed to be able to be split into an engine lower cover and an engine upper cover in an up and down direction;

the intake pathway comprises an upstream side duct and a downstream side duct, the upstream side duct being fixed to the engine upper cover of the engine cover so that air can circulate downward in the upstream side duct, the downstream side duct being fixed to the engine in parallel with the upstream side duct so that air can circulate upward in the downstream side duct;

the upstream side duct comprises an exhaust port which is opened at a side face of the upstream side duct;

the downstream side duct comprises a downstream side lower duct and a downstream side upper duct, the downstream side lower duct extending upward so as to form an air ascending flow, the downstream side lower duct comprising a suction port provided at a position opposed to the exhaust port and separately at a predetermined distance from the exhaust port, the downstream side upper duct being formed toward the throttle body of the engine above the downstream side lower duct, the downward side upper duct comprising an exhaust port communicating with the throttle body; and the upstream side duct and the downstream side duct are formed so as not to interfere with each other when the engine upper cover of the engine cover is moved vertically.

2. The outboard motor according to claim 1, wherein:

the upstream side duct is formed by:

an upstream side upper duct which is fixed to an upper portion of the engine upper cover to thereby form an upper space; and an upstream side lower duct which is fixed to a lower face of the upstream side upper duct to thereby form an air descending flow space between the upstream side lower duct and the engine upper cover, and which comprises the exhaust port opened at a side face of the upstream side lower duct.

3. The outboard motor according to claim 2, wherein:

a lower end of the upstream side duct is opened downward.

4. The outboard motor according to claim 1, wherein:

the upstream side duct comprises:

an upstream side upper duct which is fixed to an upper portion of the engine upper cover to form an upper space; and an upstream side lower duct which is formed below the upstream side upper duct to extend downward to a rear lower portion of the engine;

an upper suction port which communicates with the outside air intake port through the intake space is formed at the upstream side upper duct; and the exhaust port is provided at a side face of the upstream side lower duct.

5. The outboard motor according to claim 4, wherein:

the upper suction port is opened upward, a rising portion is formed to surround the upper suction port, and the upstream side upper duct is formed to be slanted downward to the outside air intake port.

6. The outboard motor according to claim 4, wherein:

a lower end of the upstream side duct is opened downward.

7. The outboard motor according to claim 1, wherein:

a lower end of the upstream side duct is opened downward.

* * * * *